US008317374B2

(12) United States Patent
Hedrick

(10) Patent No.: US 8,317,374 B2
(45) Date of Patent: Nov. 27, 2012

(54) MODULAR UTILITY LIGHT

(75) Inventor: Paul A. Hedrick, Benton, KY (US)

(73) Assignee: Multiway Industries (HK) Ltd., Tsuen Wan, Hong Kong (CN)

( * ) Notice: Subject to any disclaimer, the term of this patent is extended or adjusted under 35 U.S.C. 154(b) by 433 days.

(21) Appl. No.: 12/620,154

(22) Filed: Nov. 17, 2009

(65) Prior Publication Data

US 2010/0061111 A1 Mar. 11, 2010

Related U.S. Application Data

(63) Continuation-in-part of application No. 12/077,430, filed on Mar. 19, 2008, now Pat. No. 7,635,208.

(60) Provisional application No. 60/919,265, filed on Mar. 21, 2007.

(51) Int. Cl.
*F21V 21/00* (2006.01)

(52) U.S. Cl. ..... 362/398; 362/399; 362/419; 362/421; 362/427

(58) Field of Classification Search ..... 362/387, 362/397–400, 419, 421, 427
See application file for complete search history.

(56) References Cited

U.S. PATENT DOCUMENTS

| | | | | |
|---|---|---|---|---|
| 1,405,221 | A | 1/1922 | Jenkins | |
| 2,653,219 | A | 9/1953 | Popp | |
| 3,479,500 | A * | 11/1969 | Duddy | 362/388 |
| 4,141,062 | A | 2/1979 | Trueblood | |
| 4,321,660 | A | 3/1982 | Sokol | |
| 4,369,487 | A | 1/1983 | Carlow | |
| 4,533,982 | A | 8/1985 | Kozar | |
| 4,774,647 | A | 9/1988 | Kovacik et al. | |
| 5,369,559 | A | 11/1994 | Hedrick et al. | |
| 5,645,147 | A | 7/1997 | Kovacik et al. | |
| 5,833,357 | A | 11/1998 | Ting | |
| 7,635,208 | B2 * | 12/2009 | Hedrick | 362/399 |

* cited by examiner

*Primary Examiner* — Stephen F Husar
(74) *Attorney, Agent, or Firm* — Frost Brown Todd LLC

(57) ABSTRACT

A modularly constructed hand held, utility light is described and taught having a sealed electrical module and a separately attached handle module. In one embodiment. module includes two half shells that when assembled and attached to the electric module. Various embodiments of the handle module may comprise an articulation mechanism configured to allow the user to manipulate the direction of the light provided by the utility light by rotating the utility light in at least one direction. The articulation mechanism may comprise one or more of a ball and socket joint, a ratchet mechanism, or any other suitable device configured to allow a user to manipulate the direction of the light provided by the modular utility light. In another embodiment, the handle module may comprise a strap configured to facilitate cord management and/or allow a user to hang the modular utility light above a work area.

15 Claims, 14 Drawing Sheets

MODULAR UTILITY LIGHT

PRIORITY

This application is a continuation in part of U.S. patent application Ser. No. 12/077,430, filed Mar. 19, 2008, titled "Modular Utility Light," which was issued on Dec. 22, 2009 as U.S. Pat. No. 7,635,208, the disclosure of which is incorporated herein by reference, which claims priority of U.S. Provisional Patent Application Ser. No. 60/919,265, filed Mar. 21, 2007, titled "Modular Utility Light," the disclosure of which is incorporated herein by reference.

TECHNICAL FIELD

Embodiments of the present invention relate to an improved hand held utility light. More particularly embodiments relate to a modularly constructed handle for the utility light which allows for design of individual hand hold configurations, as requested by given customers, without the need for separate UL testing and approval for each individually configured light.

BACKGROUND

Hand held utility lights may comprise two half-shells which when assembled encapsulate therebetween the light bulb receptacle, the light on-off switch, and any other desired brass circuitry. For example see U.S. Pat. No. 5,833,357, issued to Ting on Nov. 10, 1998.

However, when manufacturing such utility lights for differing customers, each customer may require that the hand-hold portion of the utility light be uniquely different from their competitors. Thus manufacturing suppliers of such utility lights must individually submit each uniquely designed utility light for UL testing and approval even though the electrical portions of each utility light may be identical to that of previously approved utility lights.

In the event that a given customer desires to reconfigure their particular utility light handle, the entire newly configured utility light must be UL tested and approved even though the redesign is superficial and incorporates previously approved electrical components and circuitry.

Thus for manufacturers supplying multiple customers, such individual UL testing and approvals becomes costly and generally unnecessary.

BRIEF SUMMARY

A uniquely configured utility light is taught which may not require separate UL testing and approval when the overall appearance of the hand hold portion of the utility light is the only portion of the utility light that is reconfigured.

Embodiments of the present invention disclose a unique hand held utility light having a modular construction wherein the light includes an electrical module and a separately constructed hand hold module, thereby compressing a separate hand hold module connected to an electrical module to complete the light structure.

By this modular construction the utility light manufacturer need only submit the electrical module for UL testing and approval. Once UL tested and approved, the electrical module may be used with any uniquely designed hand hold module without separate UL testing and approval. Of the complete utility light

DETAILED DESCRIPTION

Figure 1:
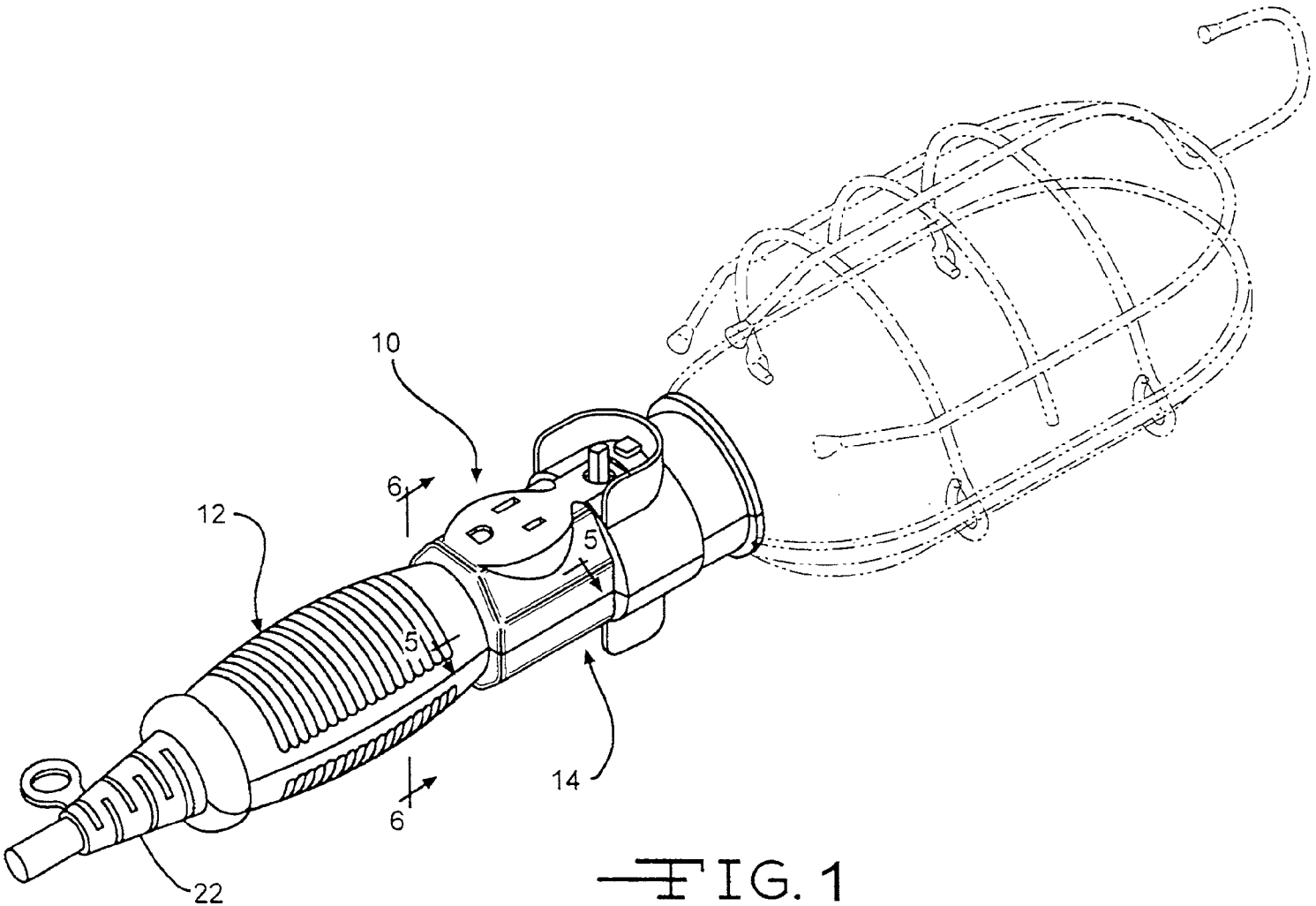
FIG. 1 presents a pictorial view of a typical utility light embodying the present invention.
Figure 2:
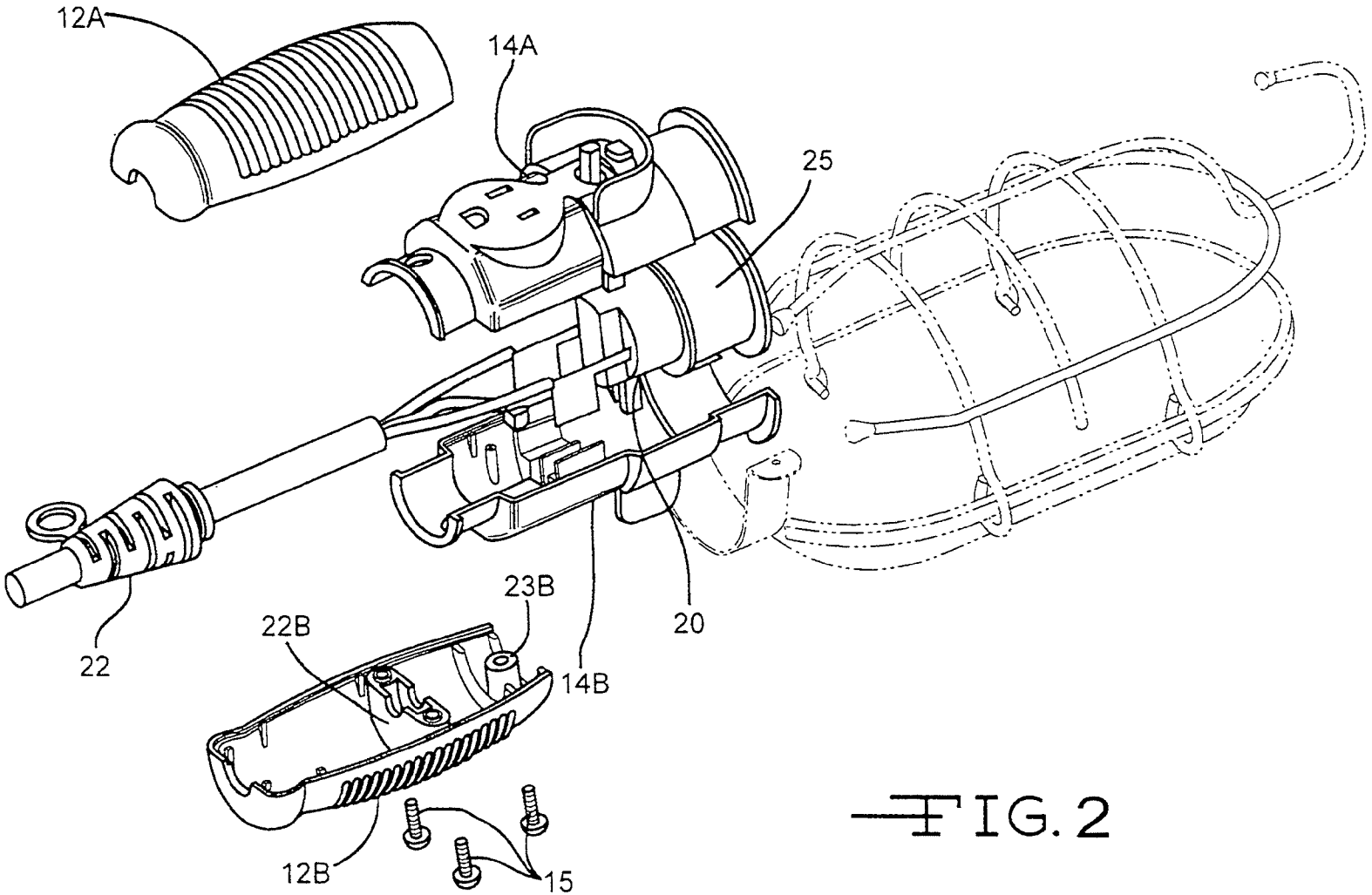
FIG. 2 presents an exploded pictorial view of the utility light illustrated in FIG. 1.
Figure 3:
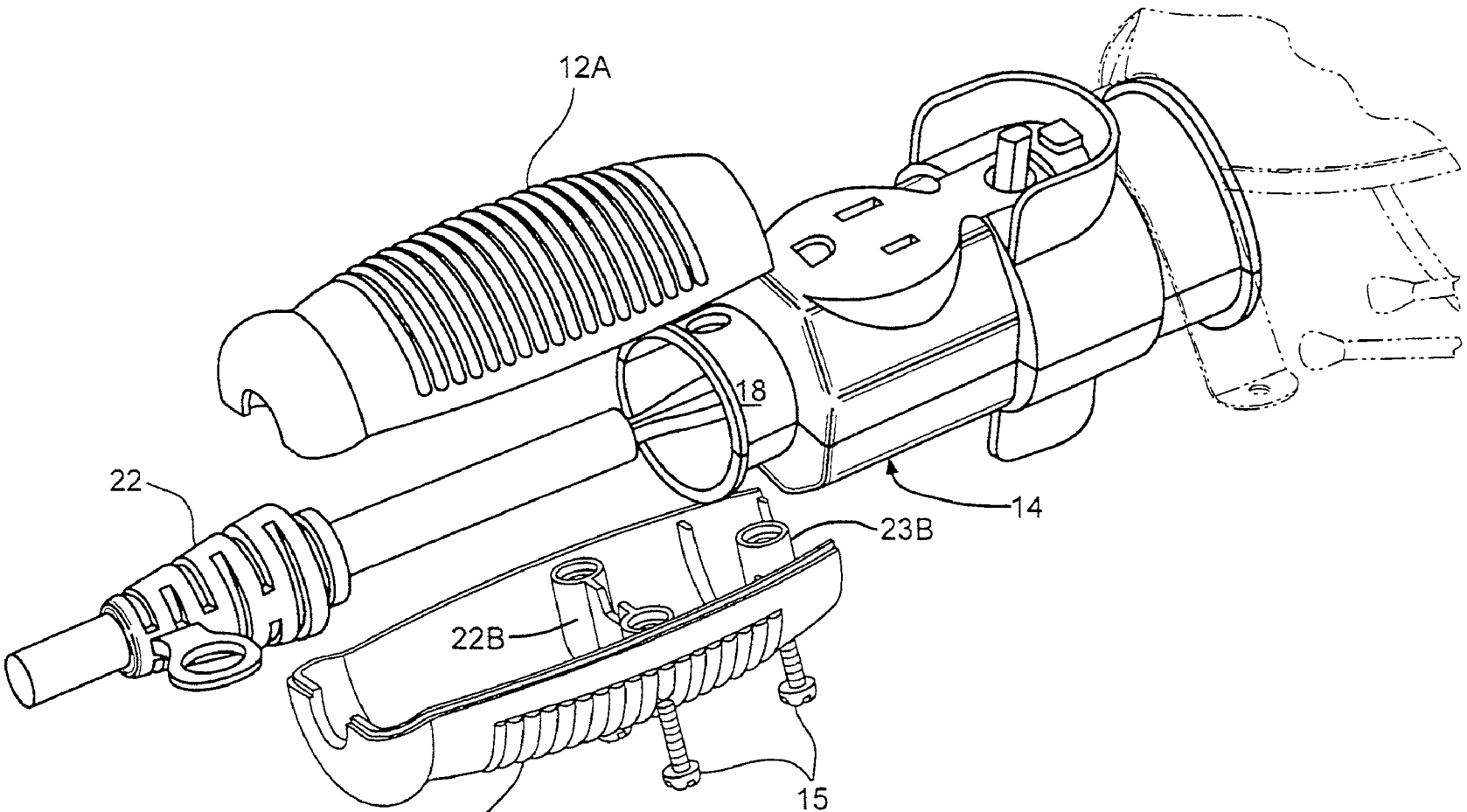
FIG. 3 presents a detailed, exploded pictorial view illustrating the assembly of the lower portion of the utility light illustrated in FIG. 1.
Figure 4:
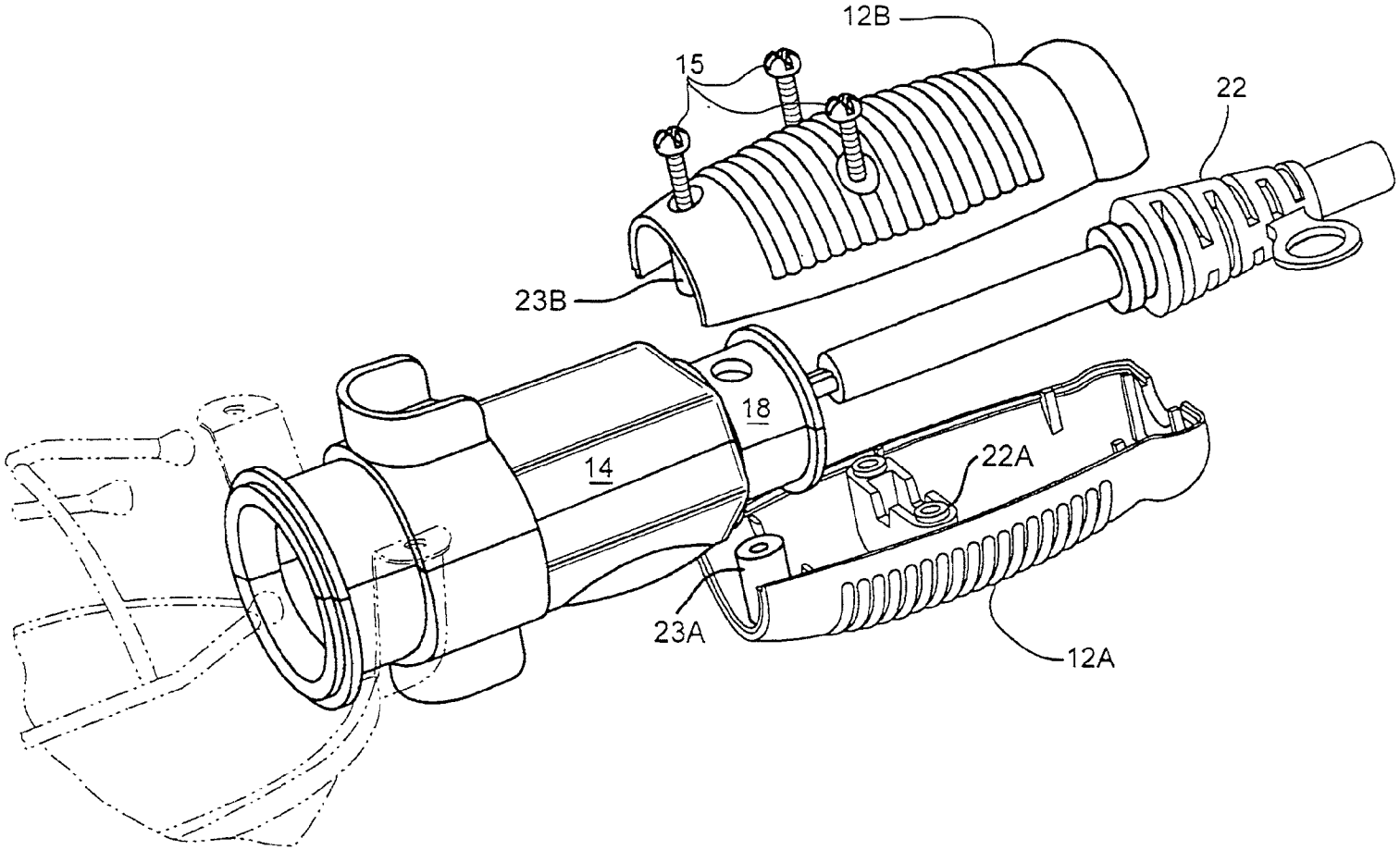
FIG. 4 presents a reverse and inverted pictorial view of FIG. 3.
Figure 6:
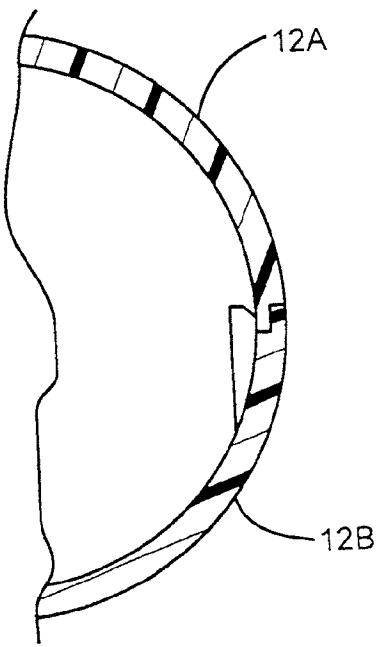
FIG. 6 presents a cross-sectional view taken along line 6-6 in FIG. 1.

FIG. 1 illustrates a utility light 10 comprising a handle module 12, an electrical module 14, and a cord 22. As illustrated in FIGS. 2, 3 and 4 handle module 12 comprises half shells 12A and 12B that when placed together, as illustrated in FIG. 6, and fastened with fasteners 15, complete the assembly of handle module 12.

Similarly, as illustrated in FIG. 2, electrical module 14 comprises two opposing shells 14A and 14B that permanently, combine to form an outer housing for electrical module 14. As illustrated, shells 14A and 14B, when assembled, encapsulate any desired brass electrical components 20 and the light bulb receptacle 25.

When assembled electrical module 14 includes a cylindrical shaped extension 18 which receives thereon handle shells 12A and 12B thereby forming the completed utility light as illustrated in FIG. 1. Post like protrusions 23A and 23B extend through an opening in extension 18, as illustrated in FIGS. 3 and 4, and are fastened by a screw 15. Two additional screws 15 extend through shell 12B and cord lock 22B, within shell 12B, and are received within cord lock 22A inside shell 12A as illustrated in FIGS. 2, 3 and 4.

Figure 5:
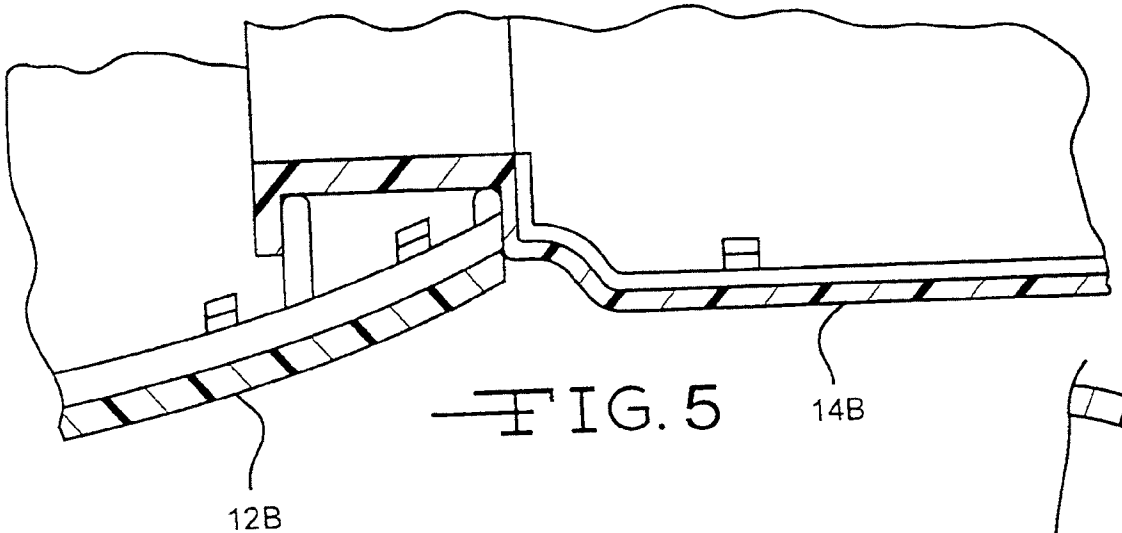
FIG. 5 presents a cross-sectional view taken along line 5-5 in FIG. 1.

Shells 12A and 12B, when assembled, further inter lock with extension 18 of electrical module 14 as illustrated in FIG. 5.

Once the electric module 14 has been designed, tested, and approved by UL, the module 14 may be joined with various handle configurations, thereby forming utility lights of various appearances and designs without undergoing individual UL testing and approval.

Figure 11:
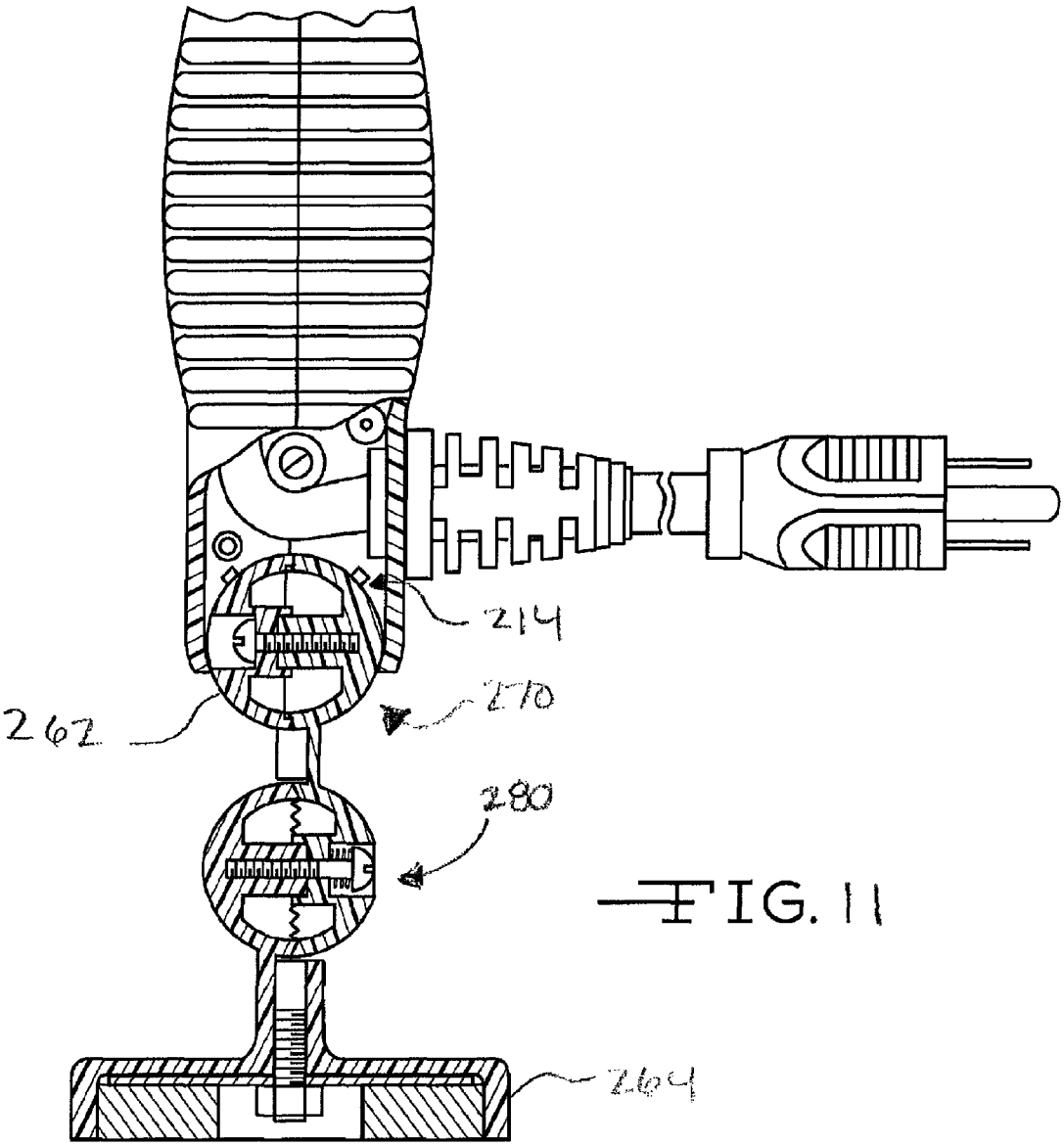
FIG. 11 presents a detailed, cross-sectional front view of the lower portion of the utility light in FIG. 10.
Figure 12:
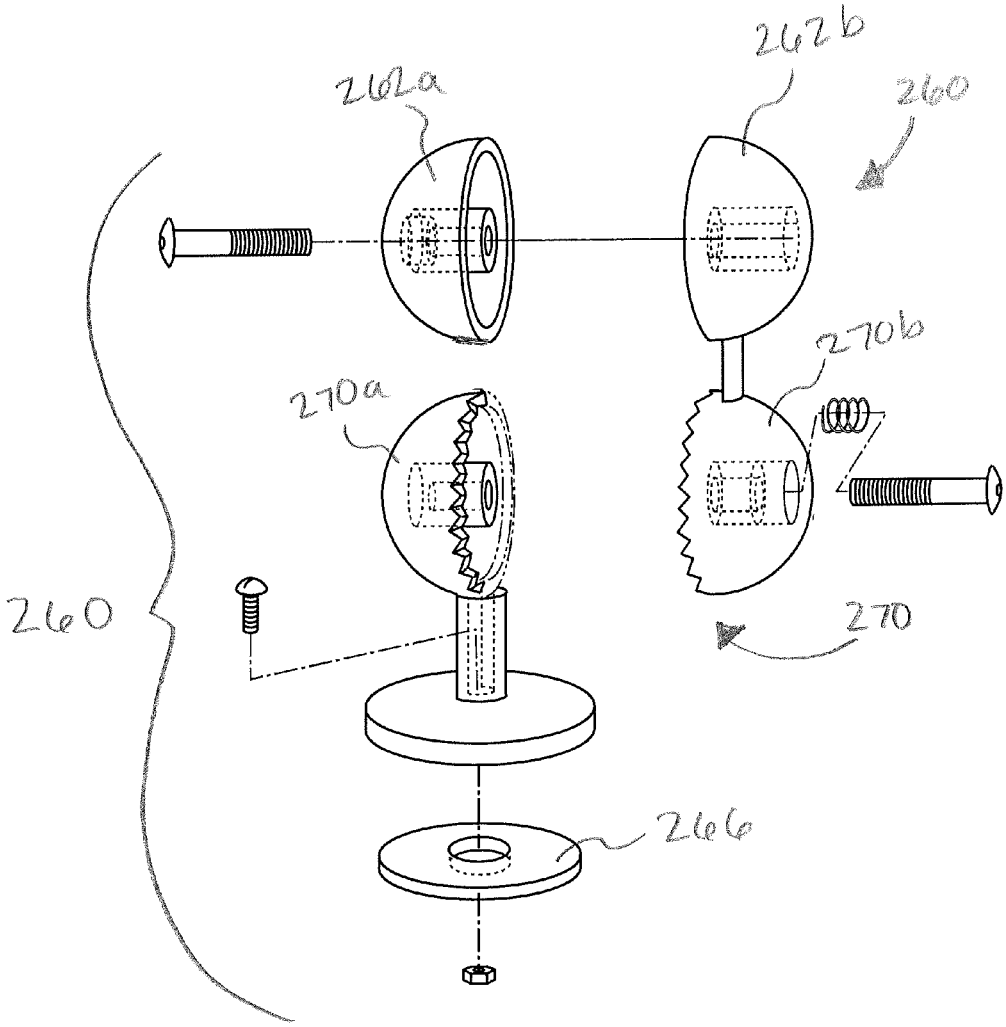
FIG. 12 presents an exploded assembly view of the articulation mechanism of the utility light in FIG. 10.
Figure 13:
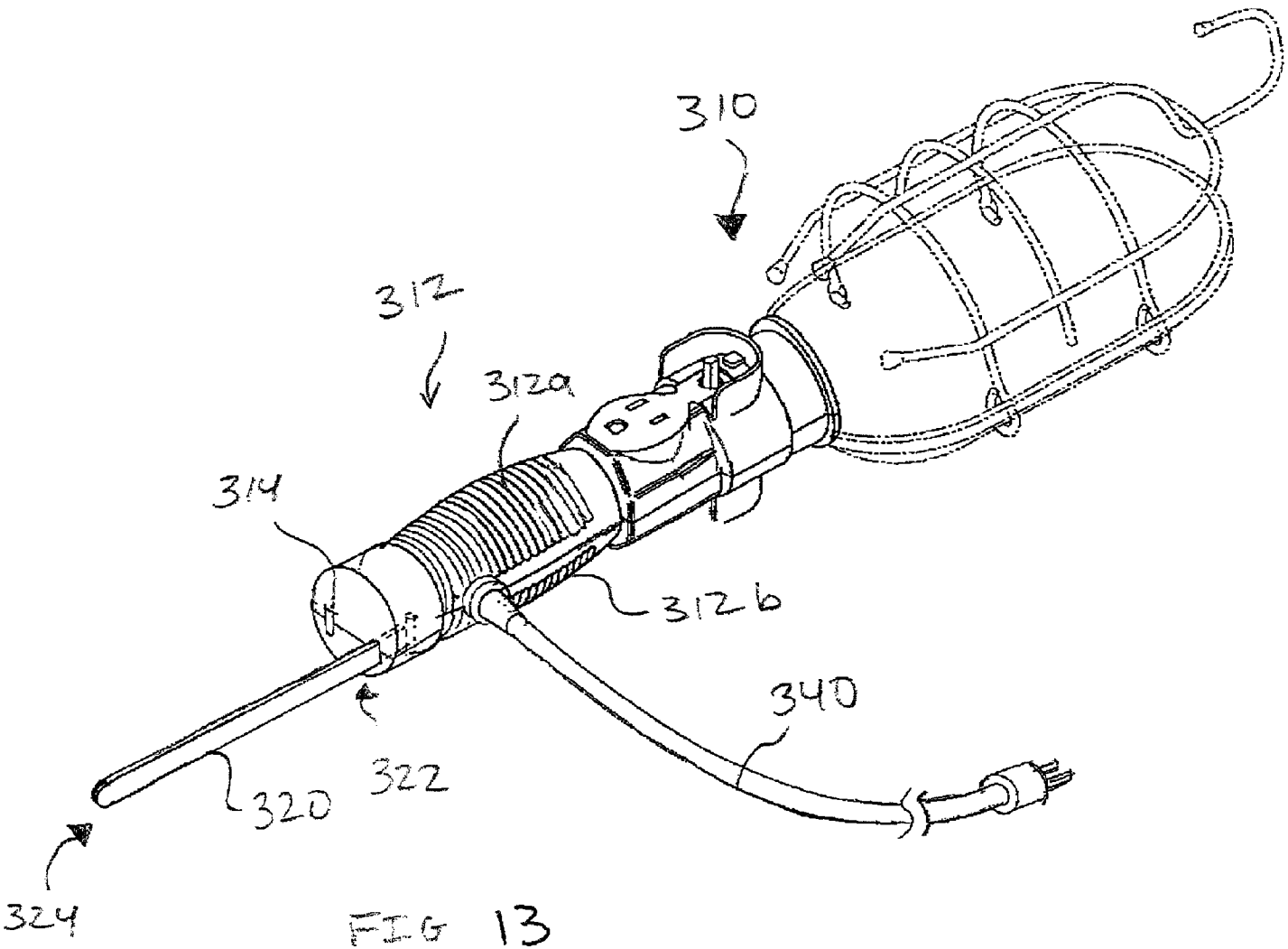
FIG. 13 presents a perspective view of an alternate embodiment of a utility light comprising a storage strap.
Figure 14:
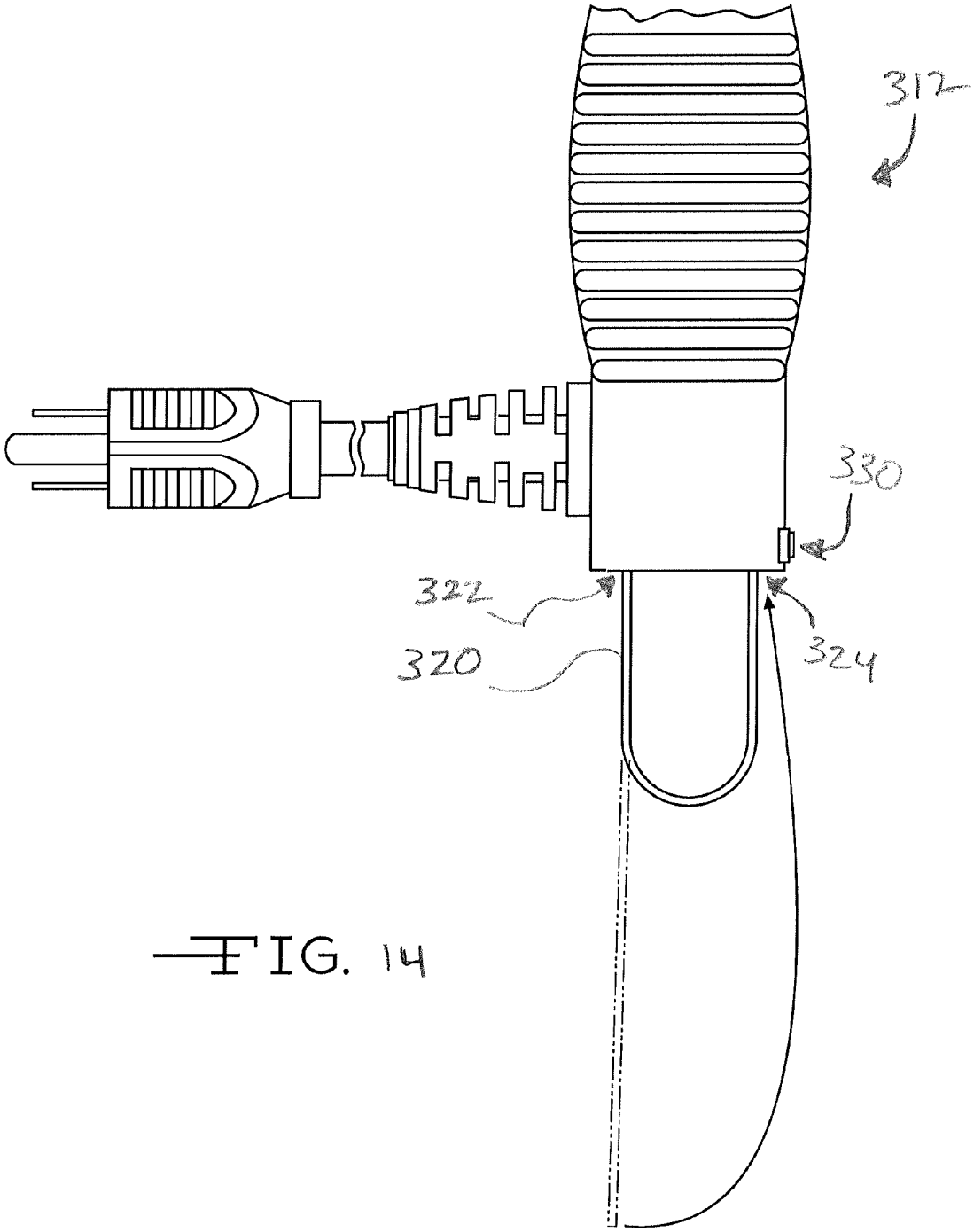
FIG. 14 presents a detailed rear view of the lower portion of the utility light in FIG. 13.
Figure 15:
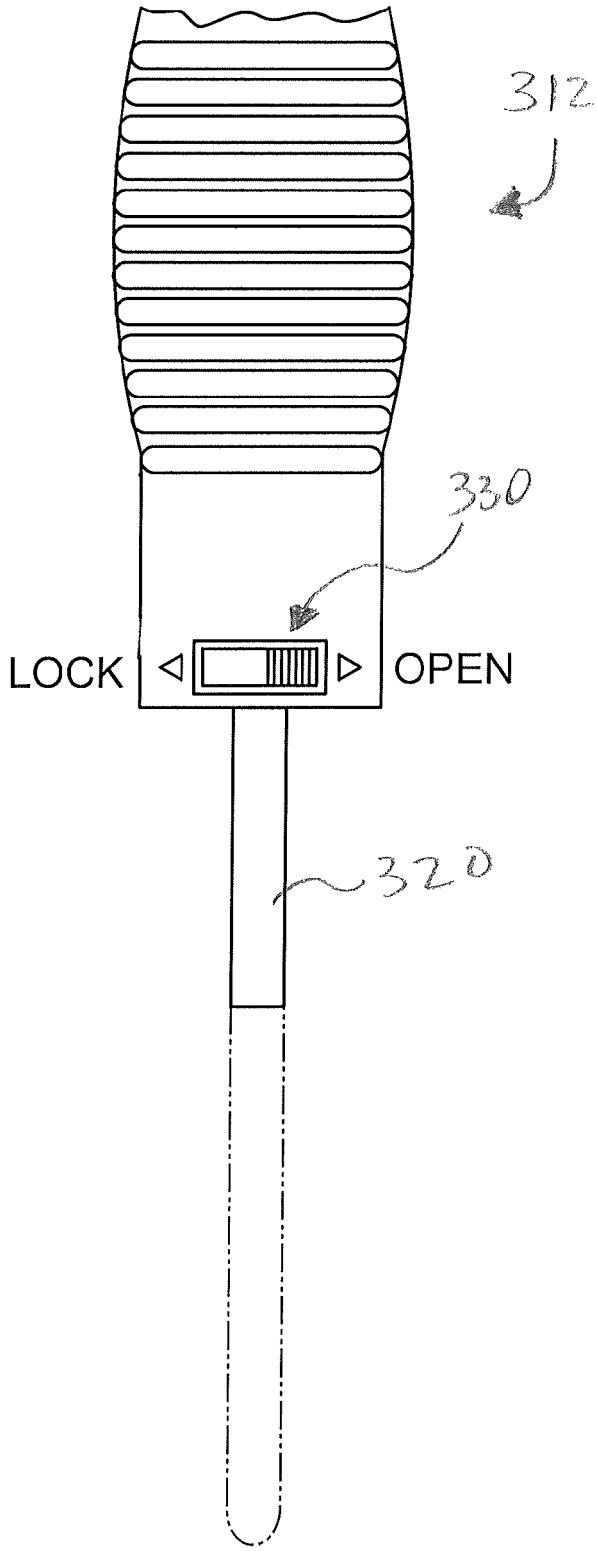
FIG. 15 presents a detailed side view of the lower portion of the utility light in FIG. 13.

By way of example only, FIGS. 7-14 depict various embodiments of alternate handle module configurations that may be joined with electric module 14. Specifically, FIGS. 7-12 depict two different handle modules, each comprising an articulation mechanism, and FIGS. 13-14 depict a handle module comprising a strap 350 and locking mechanism 360.

Figure 7:
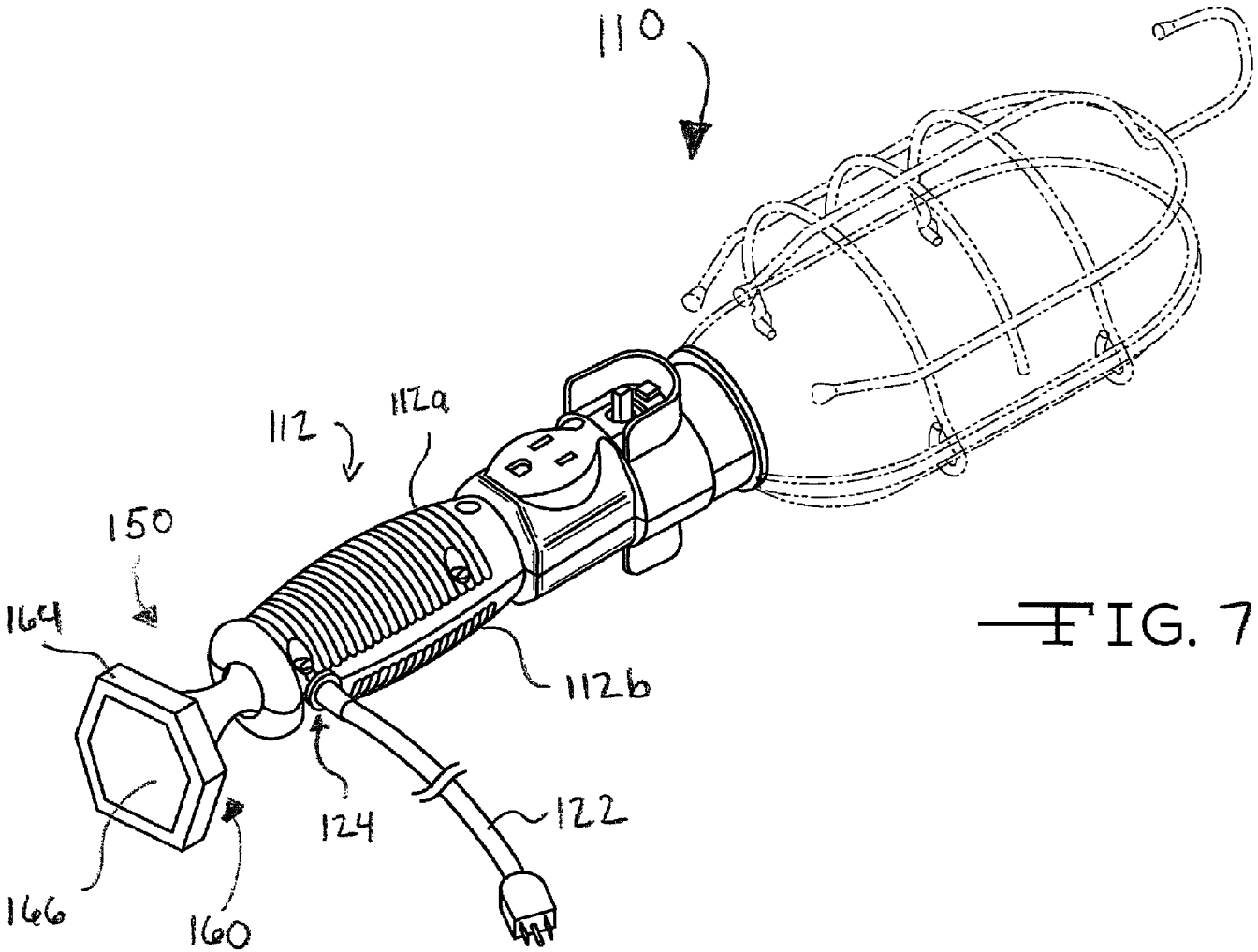
FIG. 7 presents a perspective view of an alternate embodiment of a utility light comprising an articulation mechanism.
Figure 8:
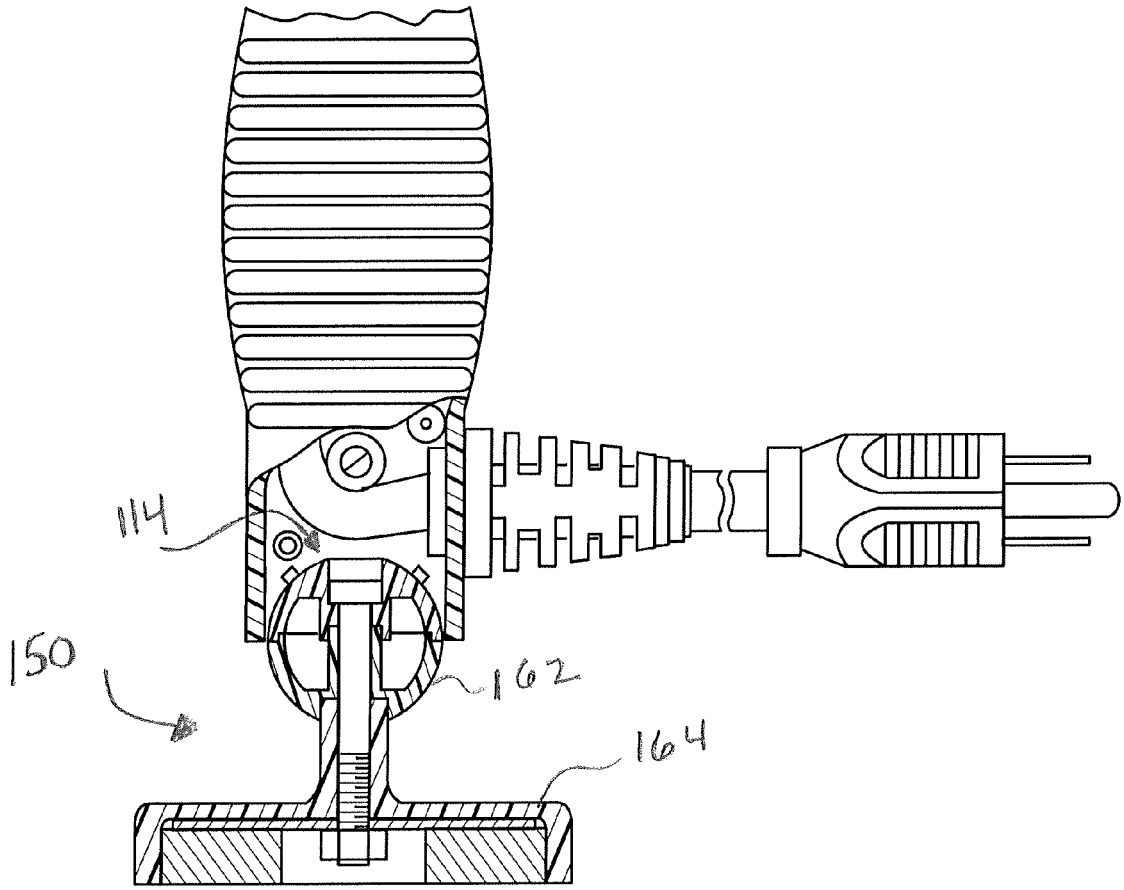
FIG. 8 presents a detailed, cross-sectional front view of the lower portion of the utility light in FIG. 7.
Figure 9:
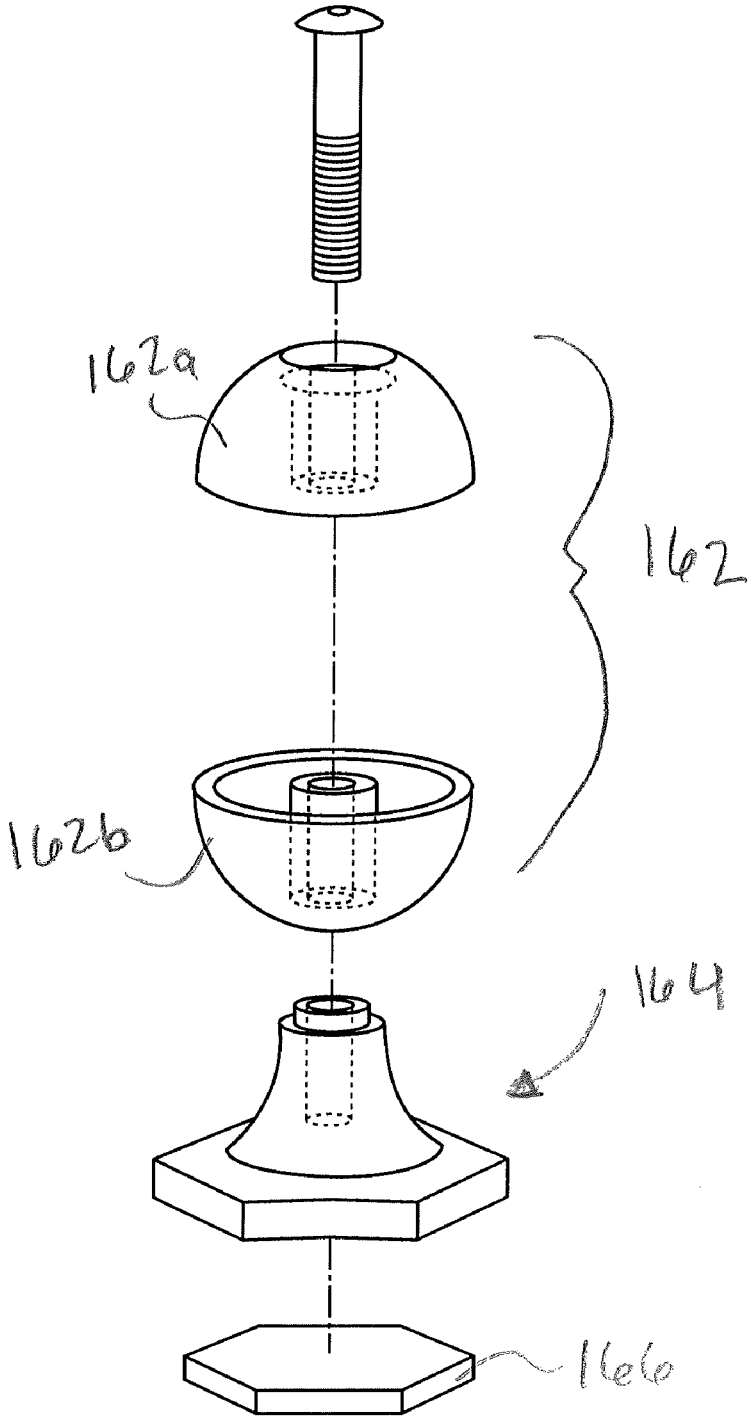
FIG. 9 presents an exploded assembly view of the articulation mechanism of the utility light in FIG. 7.

As shown in FIGS. 7-9, handle module 112 comprises a first half shell 112*a*, a second half shell 112*b* and an articulation mechanism 150. In this version, handle module 112 is configured to provide a side entry aperture 124 to receive cord 122 within handle module 112. Of course the side entry aperture 124 may be positioned on either side of handle module 112. As shown, articulation mechanism 150 comprises a ball and socket joint comprising a socket 114 formed by first half shell 112*a* and second half shell 112*b* and a base assembly 160. In this example, base assembly 160 comprises a sphere 162 and a support portion 164. The components of base assembly 160 may be configured to interlock with each other to provide a secure attachment between the components, although other suitable methods of construction may be utilized in place of or in addition to the interlocking design. Sphere 162 may comprise two spherical halves 162*a*, 162*b*, as shown in FIG. 9, or, alternatively, sphere 162 may have a unitary or other suitable construction. Socket 114 may be sized and shaped to receive at least a portion of sphere 162 such that upon assembly utility light 110 may be rotated about base assembly 160 in at least one direction. Because utility light 110 is rotatable, a user can manipulate the direction of the light provided by utility light 110 to illuminate a desired area.

As shown, the bottom of support portion 164 comprises a hexagonal shape. By way of example only, the bottom of support portion 164 may be hexagonal, square, circular, triangular, or have any other suitable shape. Of course, support portion 164 may be any suitable shape and size depending on the particular application intended by the user. Support portion 164 may be configured to provide adequate support to allow utility light 110 to be placed in a vertical orientation on a support surface. In the illustrated version, support portion 164 further comprises a magnet 166 which may be of sufficient shape, size, and strength to allow utility light 110 to be releasably mounted to a support surface, such as a metal surface, in any desired orientation. Alternatively, support portion 164 may comprise an adhesive instead of a magnet to allow utility light 110 to be fixedly or releasably attached to any suitable support surface in any desired orientation. Of course, neither the magnet nor the adhesive is required.

Figure 10:
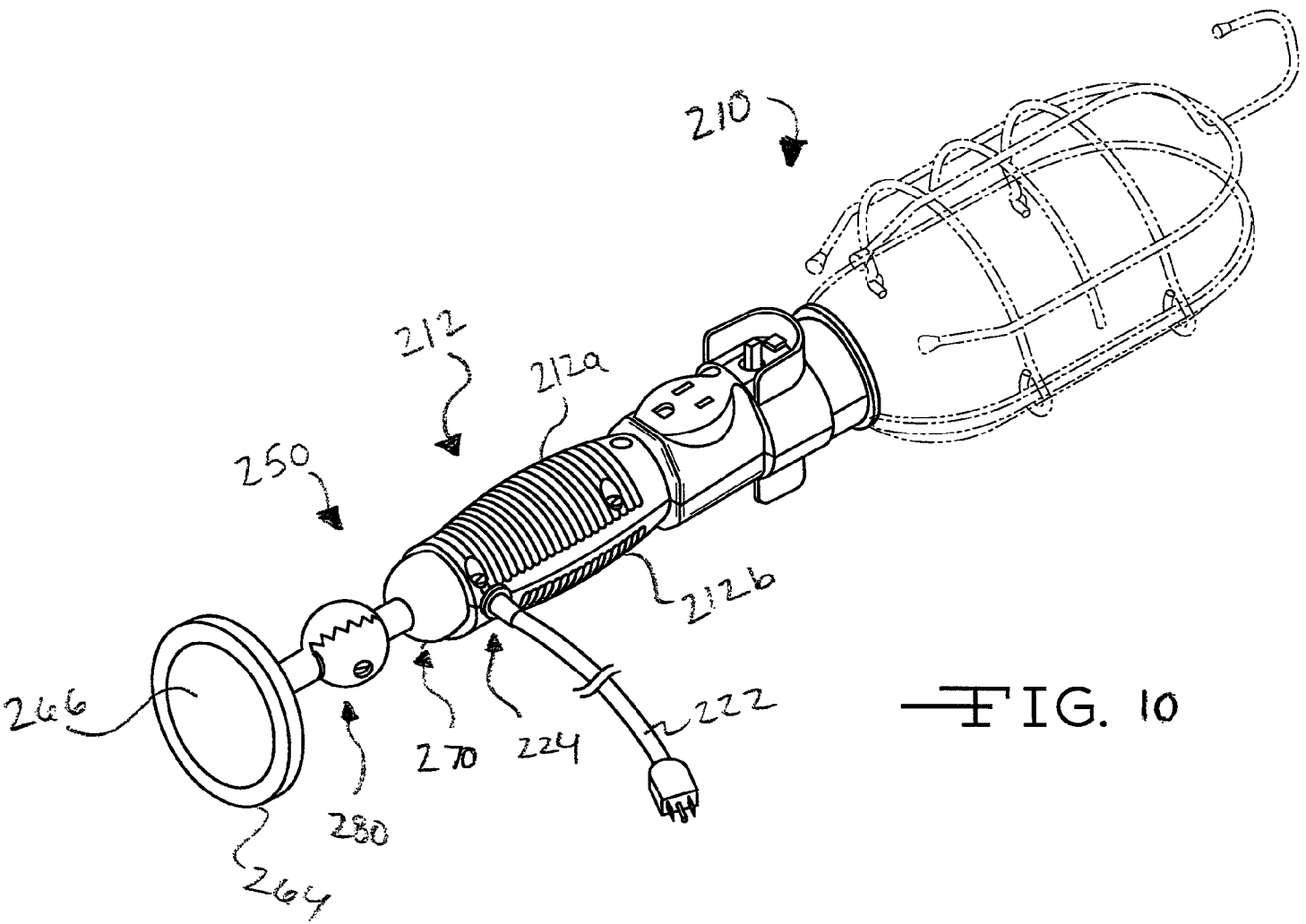
FIG. 10 presents a perspective view of an alternate embodiment of a utility light comprising an alternate articulation mechanism.

In the embodiment shown in FIGS. 10-12, handle module 212 comprises first half shell 212*a*, a second half shell 212*b* and an articulation mechanism 250. Similar to the embodiment shown in FIGS. 7-9, handle module 212 is configured to provide a side entry aperture 224 to receive cord 222 within handle module 212. Of course, side entry aperture 224 may be positioned on either side of handle module 212. As shown in FIGS. 10-12, articulation mechanism 250 comprises a base assembly 260 that includes both a ball and socket joint 270 and a ratcheting mechanism 280. In the illustrated embodiment, ball and socket joint 270 and ratcheting mechanism 280 of articulation mechanism 250 provide two discrete pivot points or points of rotation. Of course, the ball and socket joint is not required, and an alternate embodiment (not shown) may comprise an articulation mechanism that includes a ratcheting mechanism engaged with the handle module without a ball and socket joint. Base assembly 260 further comprises a support portion 264. The components of base assembly 260 may be configured to interlock with each other to provide a secure attachment between the components, although other suitable methods of construction may be utilized in place of or in addition to the interlocking design. In this example, ball and socket joint 270 comprises a sphere 262 and a socket 214 formed by first half shell 212*a* and second half shell 212*b*. Sphere 262 may comprise two spherical halves 262*a*, 262*b*, as shown in FIG. 12, or, alternatively, sphere 262 may have a unitary or other suitable construction. Socket 214 may be sized and shaped to receive at least a portion of sphere 262 such that, upon assembly, utility light 110 may be rotated about base assembly 260 in at least one direction. Ratcheting mechanism 280 may comprise any suitable ratcheting device known to those skilled in the art. Ratcheting mechanism 280 may comprise two substantially spherical halves 280*a*, 280*b*, as shown in FIG. 12, or, alternatively, ratcheting mechanism 280 may have a unitary or other suitable construction. In the illustrated embodiment, ratcheting mechanism 280 is positioned between sphere 262 and support portion 264, although other arrangements may be apparent to those of ordinary skill in the art. Ratcheting mechanism 280 may be configured to provide an additional range of motion for adjusting the orientation of utility light 210. Because utility light 210 is rotatable due to ball and socket joint 270 and further adjustable due to ratcheting mechanism 280, a user can manipulate the direction of the light provided by utility light 210 to illuminate a desired area.

As shown, the bottom of support portion 264 comprises a circular shape. By way of example only, the bottom of support portion 264 may be hexagonal, square, circular, triangular, or have any other suitable shape. Support portion 264 may be any suitable shape and size depending on the particular application intended by the user. Support portion 264 may be configured to provide adequate support to allow utility light 210 to be placed in a vertical orientation on a support surface. In the illustrated version, support portion 264 further comprises a magnet 266 which may be of sufficient shape, size, and strength to allow utility light 210 to be releasably mounted to a support surface, such as a metal surface, in any desired orientation. Alternatively, support portion 164 may comprise an adhesive instead of a magnet to allow utility light 210 to be fixedly or releasably attached to any suitable support surface in any desired orientation. Of course, neither the magnet nor the adhesive is required.

FIGS. 13-14 depict a handle module 312 comprising a first half shell 312*a*, a second half shell 312*b*, and a strap 320. In the illustrated embodiment, strap 320 comprises a fixed end 322 and a free end 324. Fixed end 322 is attached to handle module 312, and free end 324 is configured to be inserted into a slot 314 formed by first half shell 312*a* and second half shell 312*b*. It will be appreciated that the slot may be formed entirely within either first half shell 312*a* or second half shell 312*b* or formed jointly by both first half shell 312*a* and second half shell 312*b* (as shown in FIGS. 13-14). Upon insertion into slot 314, free end 324 may be releasably engaged by a locking mechanism 330. Locking mechanism 330 may comprise a rotating friction lock or any other device configured to adequately secure free end 324. Locking mechanism 330 is configured to transition between an engaged configuration and a released configuration. When free end 324 is inserted into slot 314 and locking mechanism 330 is placed in the engaged configuration, then free end 324 is fixedly engaged with locking mechanism 330 and free end 324 may not be removed. When free end 324 is inserted into slot 314 and locking mechanism is placed in the released configuration, then free end 324 is releasably engaged with locking mechanism 330 and free end 324 may be removed from slot 314. When strap 322 is in the loop configuration, as shown in FIG. 14, strap 322 may be used to help manage or store the power cord 340. Alternatively, a user may hang utility light 310 in an inverted orientation above or adjacent to a work area by placing strap 322 in the loop configuration and placing the loop around a support member.

Although a specific embodiment of the invention has been disclosed, there is no intent to thereby limit the invention to the specific embodiment illustrated herein. On the contrary, the intention herein is to cover all modifications, alternatives, embodiments, and/or equivalents of the subject invention as may fall within the spirit and scope of the invention as disclosed.

I claim:

1. A modular utility light comprising:

a) an electrical module; and b) a handle module, wherein the handle module is configured to engage the electrical module, wherein the handle module comprises (i) a first half shell, and (ii) a second half shell, wherein the first half shell and the second half shell are configured to be assembled together to form handle module body; and c) an articulation mechanism, wherein the articulation mechanism comprises a ball and socket mechanism, wherein the articulation mechanism is operably engaged with the handle module, wherein the articulation mechanism is operably configured to allow the handle module to rotate about the articulation mechanism in at least one direction.

2. The modular utility light of claim 1, wherein the ball and socket mechanism comprises:

a) a base portion; and b) a spherical portion, wherein the spherical portion is attached to the base portion, wherein the handle module further comprises a socket configured to receive at least a portion of the spherical portion, wherein the socket and the spherical portion are operably configured to allow the handle module to rotate about the spherical portion.

3. The modular utility light of claim 2, wherein the base portion further comprises a magnet.

4. The modular utility light of claim 1, wherein the articulation mechanism is configured to provide at least two discrete points of rotation for the handle module.

5. The modular utility light of claim 1, wherein when the handle module is engaged with the electrical module at least a portion of the electrical module extends out of the handle module.

6. A modular utility light comprising:

a) an electrical module, wherein the electrical module contains an electrical element therein; and b) a handle module, wherein the handle module is configured to interlock with the electrical module to form a utility light body, wherein the handle module comprises (i) a first half shell, and (ii) a second half shell, wherein the first half shell and the second half shell are configured to be assembled together to form a handle module body, wherein the first half shell and second half shell are configured to form a socket upon assembly; and c) a base assembly, wherein the base assembly is configured to engage the handle module such that the utility light body is rotatable about the base assembly, wherein the base assembly comprises (i) a sphere, wherein the sphere is configured to be at least partially received within the socket thereby engaging the handle module, and (ii) a support portion, wherein the support portion is attached to the sphere.

7. The modular utility light of claim 6, wherein the base assembly further comprises a ratcheting mechanism, wherein the ratcheting mechanism is positioned between the base portion and the sphere.

8. A modular utility light comprising:

a) an electrical module; and b) a handle module, wherein the handle module is configured to interlock with the electrical module to form a utility light body, wherein the handle module comprises (i) a first half shell, and (ii) a second half shell, wherein the first half shell and the second half shell are configured to be assembled together to form a handle module body, wherein the handle module body comprises one or more slots;

c) a strap, wherein the strap comprises a fixed end and a free end, wherein the strap is attached to the handle module at the fixed end, wherein the free end of the strap is configured to be releasably received by the one or more slots; and d) a locking mechanism, wherein the locking mechanism is configured to transition between an engaged configuration and a released configuration, wherein the locking mechanism is configured to prevent the free end of the strap from being removed from the one or more slots when the locking mechanism is in the engaged configuration, wherein the locking mechanism is configured to allow the free end of the strap to be removed from the one or more slots when the locking mechanism is in the released configuration.

9. The modular utility light of claim 8, wherein the locking mechanism comprises a rotating friction lock.

10. A modular utility light comprising:

a) an electrical module, wherein the electrical module contains therein electrical elements required to make the utility light electrically functional;

b) a separate handle module, wherein the handle module comprises a first half shell and a second half shell that together, when assembled, form a body of the handle module, wherein the assembled handle module interlocks with the electrical module thereby forming a utility light body, wherein when the handle module is assembled together with the electrical module at least a portion of the electrical module extends out of the handle module; and c) an articulation mechanism, wherein the articulation mechanism comprises a ratcheting mechanism, wherein the articulation mechanism is engaged with the handle module, wherein the articulation mechanism is operably configured to allow the handle module to rotate about the articulation mechanism in at least one direction.

11. A modular utility light comprising:

a) an electrical module; and a handle module, wherein the handle module is configured to engage the electrical module, wherein the handle module comprises (i) a first half shell, and (ii) a second half shell, wherein the first half shell and the second half shell are configured to be assembled together to form handle module body; and c) an articulation mechanism, wherein the articulation mechanism comprises a ratcheting mechanism, wherein the articulation mechanism is engaged with the handle module, wherein the articulation mechanism is operably configured to allow the handle module to rotate about the articulation mechanism in at least one direction.

12. The modular utility light of claim 11, wherein the ratcheting mechanism comprises:

a) a base portion; and b) a spherical portion, wherein the spherical portion comprises a plurality of ratchet teeth operably configured to allow the handle module to rotate about the spherical portion.

13. The modular utility light of claim 12, wherein the base portion further comprises a magnet.

14. The modular utility light of claim 11, wherein the articulation mechanism is configured to provide at least two discrete points of rotation for the handle module.

15. The modular utility light of claim 11, wherein when the handle module is engaged with the electrical module at least a portion of the electrical module extends out of the handle module.

* * * * *

UNITED STATES PATENT AND TRADEMARK OFFICE

CERTIFICATE OF CORRECTION

PATENT NO. : 8,317,374 B2
APPLICATION NO. : 12/620154
DATED : November 27, 2012
INVENTOR(S) : Paul A. Hedrick It is certified that error appears in the above-identified patent and that said Letters Patent is hereby corrected as shown below:

Column 5, Claim 1, line 22, reads "...wherein the articulation mechanism is operably engaged..." and should be changed to read "...wherein the articulation mechanism is engaged"

Signed and Sealed this
Twelfth Day of February, 2013

Teresa Stanek Rea
*Acting Director of the United States Patent and Trademark Office*